US007770670B2

(12) United States Patent
Gourley et al.

(10) Patent No.: US 7,770,670 B2
(45) Date of Patent: Aug. 10, 2010

(54) APPARATUS FOR ROTARY MINING

(76) Inventors: Larry P. Gourley, 715 Frosty Rd., New Bethlehem, PA (US) 16242; Allen J. Gourley, 1933 Sheriden Rd., New Bethlehem, PA (US) 16242

( * ) Notice: Subject to any disclaimer, the term of this patent is extended or adjusted under 35 U.S.C. 154(b) by 135 days.

(21) Appl. No.: 11/897,132

(22) Filed: Aug. 29, 2007

(65) Prior Publication Data

US 2009/0057013 A1 Mar. 5, 2009

(51) Int. Cl.
*E21B 10/32* (2006.01)

(52) U.S. Cl. ..... 175/284; 175/321

(58) Field of Classification Search ..... 175/284, 175/321, 291, 53, 19, 266; 299/15, 20, 21, 299/39.3

See application file for complete search history.

(56) References Cited

U.S. PATENT DOCUMENTS

| | | | | |
|---|---|---|---|---|
| 1,402,503 | A * | 1/1922 | Krause | 175/284 |
| 1,423,625 | A | 7/1922 | Rogers | |
| 2,450,223 | A * | 9/1948 | Barbour | 175/271 |
| 3,236,320 | A * | 2/1966 | Russ | 175/263 |
| 3,343,614 | A | 9/1967 | Parisien | |
| 3,472,553 | A | 10/1969 | Miller | |
| 4,007,797 | A * | 2/1977 | Jeter | 175/26 |
| 6,065,551 | A | 5/2000 | Gourley et al. | |

FOREIGN PATENT DOCUMENTS

| | | | |
|---|---|---|---|
| DE | 544182 | C | 2/1932 |
| FR | 2575776 | A1 | 7/1986 |
| GB | 1381575 | A | 1/1975 |
| GB | 1416624 | A | 12/1975 |
| GB | 1427528 | A | 3/1976 |

OTHER PUBLICATIONS

International Search Report for International Application No. PCT/US2008/072317 dated Jun. 8, 2008.
Written Report for International Application No. PCT/US2008/072317 dated Jun. 8, 2008.

* cited by examiner

*Primary Examiner*—Jennifer H Gay
*Assistant Examiner*—Catherine Loikith
(74) *Attorney, Agent, or Firm*—K&L Gates LLP

(57) ABSTRACT

In various embodiments, a mining device can include a first housing portion and a second housing portion where relative movement between the first and second housing portions can extend and/or retract a cutting member with respect to the mining device. The mining device can further include a cable which can be mounted to the second housing portion where the cutting member is mounted to the cable and can be radially extended with respect to the first and second housing portions when the second housing portion is moved relative to the first housing portion along an axis. As the cutting member is extended, it can contact the sidewalls of a subterranean shaft to loosen material therefrom.

15 Claims, 5 Drawing Sheets

APPARATUS FOR ROTARY MINING

BACKGROUND

1. Field of the Invention

The present invention is generally directed to methods and devices for mining, and, more particularly, to methods and devices for rotary mining.

2. Description of the Related Art

Several conventional mining techniques can be employed to remove subterranean material. Such techniques commonly utilize machinery adapted to remove coal, for example, from seams that are relatively deep beneath the surface and require a network of mines comprising underground shafts and passages to access the seams. Such machinery is used to loosen material from the seams and transport the material to the surface; however, personnel are required to enter the mines to operate the machinery thereby placing them in dangerous underground conditions. Another mining technique, commonly referred to as surface, or strip, mining, is used to remove material that is relatively close to the surface. In strip mining, overlying dirt, rocks, and gravel, i.e., overburden, is removed from the ground to expose a coal seam, for example. However, strip mining often requires the use of expensive machinery to remove the overburden and often has an adverse environmental impact on the area being mined.

Other mining techniques and devices have been recently developed which solve many of the above-described problems. U.S. Pat. No. 6,065,551, for example, discloses such methods and devices. In one exemplary embodiment, a rotary mining device having radially extendable cutting members is inserted into a subterranean shaft, or bore hole, to loosen material from the sidewalls of the shaft. In such embodiments, a coal seam can be comminuted into powder, drawn up the shaft and collected when it reaches the surface. As a result, the expense of developing a network of underground passages is obviated and the surrounding environment can be substantially preserved. As disclosed therein, the cutting members are radially extended and retracted with respect to the mining device as a result of centrifugal force acting on the cutting members when the mining device is rotated. More particularly, as the rotational speed of the mining device is increased, the centrifugal force acting on the cutting members is also increased and, as a result, the cutting devices are extended further away from the mining device. Similarly, as the rotational speed on the mining device is decreased, the centrifugal force acting on the cutting members is also decreased and, as a result, springs within the mining device can retract the cutting members. Although such devices are quite successful for achieving their intended purpose, the speed of the mining device and the distance which the cutting members are extended from the mining device are directly, and indivisibly, related. As a result, the operating conditions of the mining device can be somewhat limited which can, in some circumstances, decrease the efficiency and, thus, the profitability of the mining device. What is needed is an improvement over the foregoing.

SUMMARY

In one form of the present invention, the cutting members of a mining device can be extended and retracted with respect to the mining device in a manner which is independent of the rotational speed of the mining device. In various embodiments, the mining device can include a first housing portion and a second housing portion where relative movement between the first and second housing portions can extend and/or retract the cutting members with respect to the mining device. In at least one embodiment, the mining device can include a first housing portion which defines an axis, and a second housing portion, where the second housing portion is movable relative to the first housing portion along the axis. The mining device can further include a cable which can be mounted to the second housing portion, and a cutting member mounted to the cable, where the cutting member can be configured to be rotated about the axis when the first and second housing portions are rotated about the axis. In these embodiments, the cutting member can be radially extended with respect to the axis when the second housing portion is moved relative to the first housing portion along the axis. As the cutting member is extended, it can contact the sidewalls of a subterranean shaft, or bore hole, to loosen material therefrom.

BRIEF DESCRIPTION OF THE DRAWINGS

The above-mentioned and other features and advantages of the present invention, and the manner of attaining them, will become more apparent and the invention itself will be better understood by reference to the following description of embodiments of the invention taken in conjunction with the accompanying drawings, wherein.

Corresponding reference characters indicate corresponding parts throughout the several views. The exemplifications set out herein illustrate preferred embodiments of the invention, in one form, and such exemplifications are not to be construed as limiting the scope of the invention in any manner.

DETAILED DESCRIPTION

As outlined above, rotary mining devices, and methods for using the same, have been developed to mine material from the ground. Such devices and methods are disclosed in U.S. Pat. No. 6,065,551, entitled METHOD AND APPARATUS FOR ROTARY MINING, filed on Apr. 17, 1998, the entire disclosure of which is hereby expressly incorporated by reference herein. In use, a hole can be drilled in the ground in a vertical, horizontal, or any other suitable direction and the rotary mining device can be inserted into the hole. In other various embodiments, the mining device can be used to drill the hole. In either event, once the mining device is positioned in the hole, the mining device can be rotated therein in order to loosen or dislodge material from the sidewalls of the hole. The material can be removed from the hole as the mining device is being rotated within the hole and/or after the mining device has been withdrawn from the hole.

Figure 1:
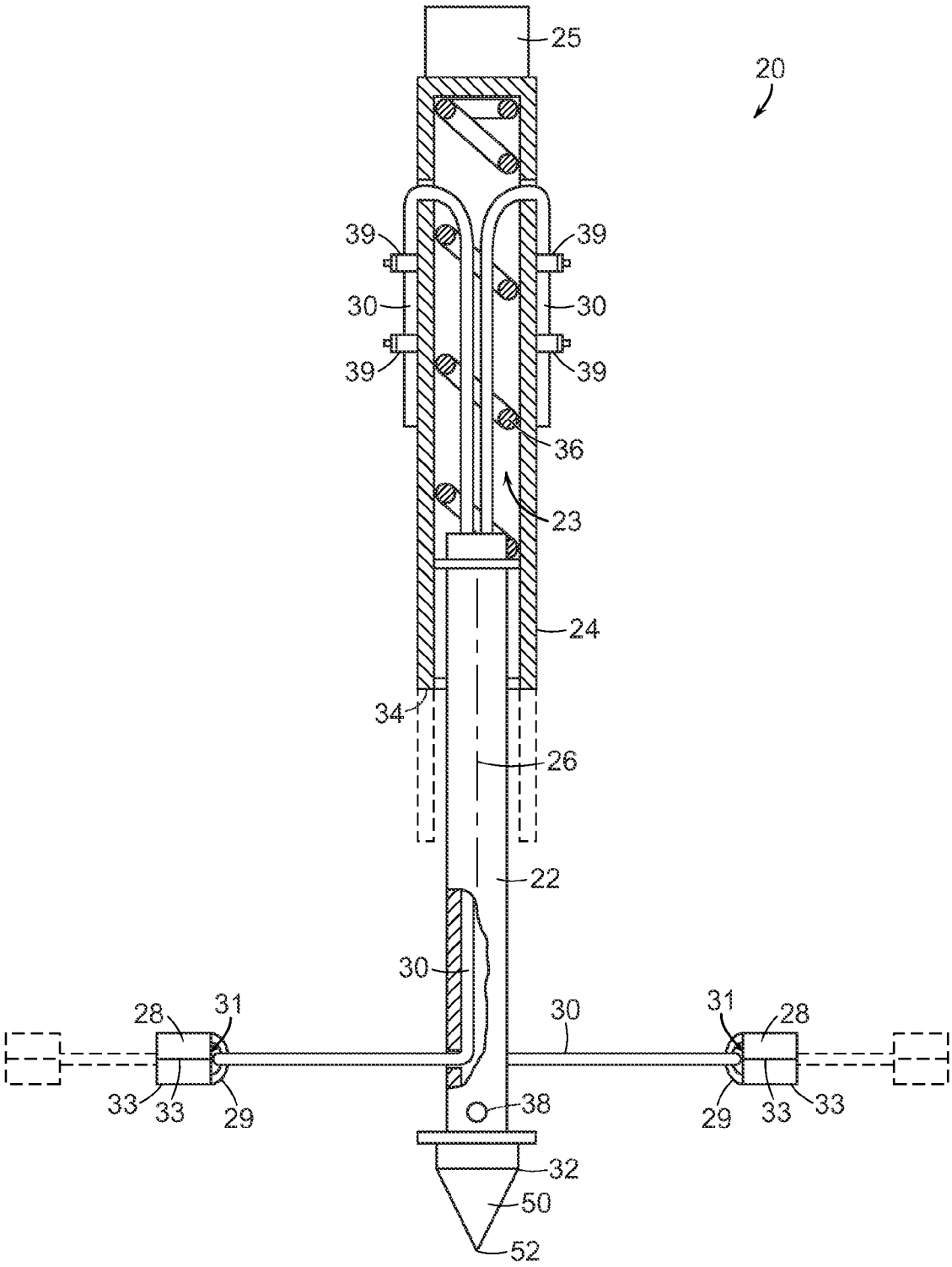
FIG. 1 is an elevational view of a mining device in accordance with an embodiment of the present invention with portions of the mining device illustrated in cross-section.

Referring to FIG. 1, mining device 20 can include first housing portion 22 and second housing portion 24 where housing portions 22 and 24 can be moved relative to each other along an axis. In the illustrated embodiment, first housing portion 22 can define axis 26 along which second housing 24 can be moved to deploy cutting members 28, as described in further detail below. First housing portion 22 and second housing portion 24 can have any suitable cross-sectional geometry including a substantially round and/or square cross-section, for example. In various embodiments, the cross-sectional geometry of housing portions 22 and 24 can be configured such that when second housing portion 24 is rotated about axis 26, for example, second housing portion 24 engages first housing portion 22 and rotates it about axis 26. Although not illustrated, one of housing portions 22 and 24 can further include at least one key and the other of housing portions 22 and 24 can include at least one groove which co-operates with the at least one key to limit relative rotational movement between housing portions 22 and 24.

Referring to FIG. 1, second housing portion 24 can include proximal end 25 which can be configured to be connected to the drill stem of a drilling rig, engaged to a hydraulic or electric motor, and/or rotated by a pneumatic drive system, for example. Such drive systems can provide rotational movement to second housing portion 24 and, in addition, translational movement to housing portion 24 such that housing portion 24 can be moved relative to first housing portion 22 along an axis as described above. In use, referring primarily to FIGS. 1 and 2, mining device 20 can be lowered into hole 21 such that cutting members 28 are substantially aligned with a seam of material sought to be extracted, such as coal, minerals, ore, shale, sand, or rock, for example. In various embodiments, as mining device 20 is inserted into hole 21, cutting members 28 can be positioned against or adjacent to first housing portion 22. Thereafter, mining device 20 can be rotated to remove material from the sidewalls of hole 21.

After a period of time, owing to the rotation of cutting members 28 about axis 26, cutting members 28 can clear a cylinder of material surrounding device 20. Alternative embodiments are envisioned, however, in which device 20 is permitted to rotate eccentrically about an axis, for example, in order to clear a non-cylindrical volume of material. Stated another way, embodiments are envisioned in which first housing portion 22 and/or second housing portion 24 are rotated about an axis which is not collinear with the geometrical or symmetrical axis of device 20. In either event, in order to increase the diameter of the cleared material around the mining device, cutting members 28 can be extended radially with respect to axis 26. In various embodiments, referring to FIG. 2, the position of cutting members 28 relative to axis 26 can be controlled by relative movement between first housing portion 22 and second housing portion 24. More particularly, referring to FIG. 1, cables 30 can be mounted to second housing portion 24 such that when distal end 34 of second housing portion 24 is moved toward distal end 32 of first housing portion 22, slack is created in cables 30 which can allow the centrifugal forces acting on cutting members 28, illustrated as vectors Fc in FIG. 2, to pull cutting members 28 outwardly and increase their radial position with respect to axis 26. In effect, cutting members 28 can be moved between a first radial position and a second radial position with respect to axis 26 in a manner independent of the speed at which the mining device is rotated.

In order to generate relative movement between first housing portion 22 and second housing portion 24 as described above, first housing portion 22 can be positioned within the bore hole such that first housing portion 22 contacts the bottom of the bore hole and second housing portion 24 can be moved relative thereto. In circumstances where first housing portion 22 cannot contact the bottom of the bore hole, device 20 can further include a packer, such as a hook wall packer, for example, an expandable anchor, and/or any other suitable device for engaging the side walls of the bore hole. In such embodiments, first housing portion 22 can be selectively engaged with the side walls of the bore hole and, once engaged therewith, second housing portion 24 can be moved relative thereto. In at least one embodiment, as a result, a bore hole can be drilled which passes through more than one seam of material, for example, and the mining device can be positioned at different depths within the bore hole to mine the seams of material. In either event, as outlined above, device 20 can be positioned within a hole such that proximal end 25 of second housing portion 24 can receive a force thereto to move second housing portion 24 relative to first housing portion 22 and deploy cutting members 28 outwardly. In embodiments where proximal end 25 is positioned above the ground, such a force can be applied directly to proximal end 25. In embodiments where proximal end 25 is positioned within the hole, a connector can be engaged with proximal end 25 such that the force is transmitted to proximal end 25 through the connector.

In various embodiments, a force can be applied to proximal end 25 in a periodic manner. In such embodiments, proximal end 25 can be moved downwardly a predetermined distance, paused, and then moved downwardly again. In such embodiments, cutting members 28 may be afforded an opportunity to clear the material within their radius before being moved outwardly once again. In at least one embodiment, proximal end 25 can be forced downwardly at a constant rate. In such embodiments, cutting members 28 can be extended radially at a constant rate and, if the rotational speed of cutting device 20 is held constant, the tangential velocity of cutting members 28 can be increased at a constant rate as well. In other various embodiments, proximal end 25 of second housing portion 24 can be forced downwardly at a non-constant rate. In at least one such embodiment, the rate at which proximal end 25 is moved downwardly and, correspondingly, the rate at which cutting members 28 are deployed radially, can decrease as the radius between cutting members 28 and axis 26 increases. Such embodiments may be useful where large changes in the kinetic energy of cutting members 28 are undesirable. Stated another way, as the kinetic energy of cutting members 28 is proportional to the square of the velocity of cutting members 28, even small changes to the radius, and thus velocity, of cutting members 28 may result in large changes to the kinetic energy of cutting members 28 when they are radially extended at large distances.

As described above, cables 30 can be mounted to second housing portion 24. In various embodiments, cables 30 can be comprised of at least one of a solid-core cable, a twisted-strand cable, a chain, a rope, a hollow tube, and/or any other 'cable' comprised of a suitable material. In at least one embodiment, cables 30 can be comprised of a directional cable which can be configured to deflect in one, or only a few, pre-selected directions. In such embodiments, the directional cable can be configured to withstand an axial load applied therto without deflecting in select directions. In any event, the term 'cable', as used herein, is meant to include at least the above-described embodiments and can include any suitable flexible connecting member. In various embodiments, referring to FIG. 1, mining device 20 can include brackets 39 which, when fastened to second housing portion 24, can capture cables 30 against the outside surface thereof. Although cables 30 are illustrated as being mounted to the outside of housing portion 24, the invention is not so limited. In various embodiments, cables 30 can be mounted to the interior of housing portion 24 or, in other embodiments, tethered to second housing portion 24 via apertures in housing portion 24 and/or projections extending therefrom in any suitable manner. In any event, cables 30 can be mounted to mining device 20 such that cables 30 are substantially secured to second housing portion 24, or any other suitable portion of the mining device.

After a desired amount of material has been removed from the seam, for example, cutting members 28 can be retracted from their extended position. More particularly, distal end 34 of second housing portion 24 can be translated away from distal end 32 of first housing portion 22 by applying a force to proximal end 25 in order to draw cables 30 into cavity 23 of mining device 20 and position cutting members 28 against or adjacent to first housing portion 22. In at least one embodiment, proximal end 25 of second housing portion 24 can be pulled upwardly by the drilling rig or motor engaged therewith, for example, in order to move housing portion 24 relative to first housing portion 22. In various embodiments, mining device 20 can further include spring 36 which can be positioned intermediate first housing portion 22 and second housing portion 24. Spring 36 can be configured to move, or push, second housing portion 24 upward relative to and away from first housing portion 22 to retract, or assist in retracting, cutting members 28.

Figure 2:
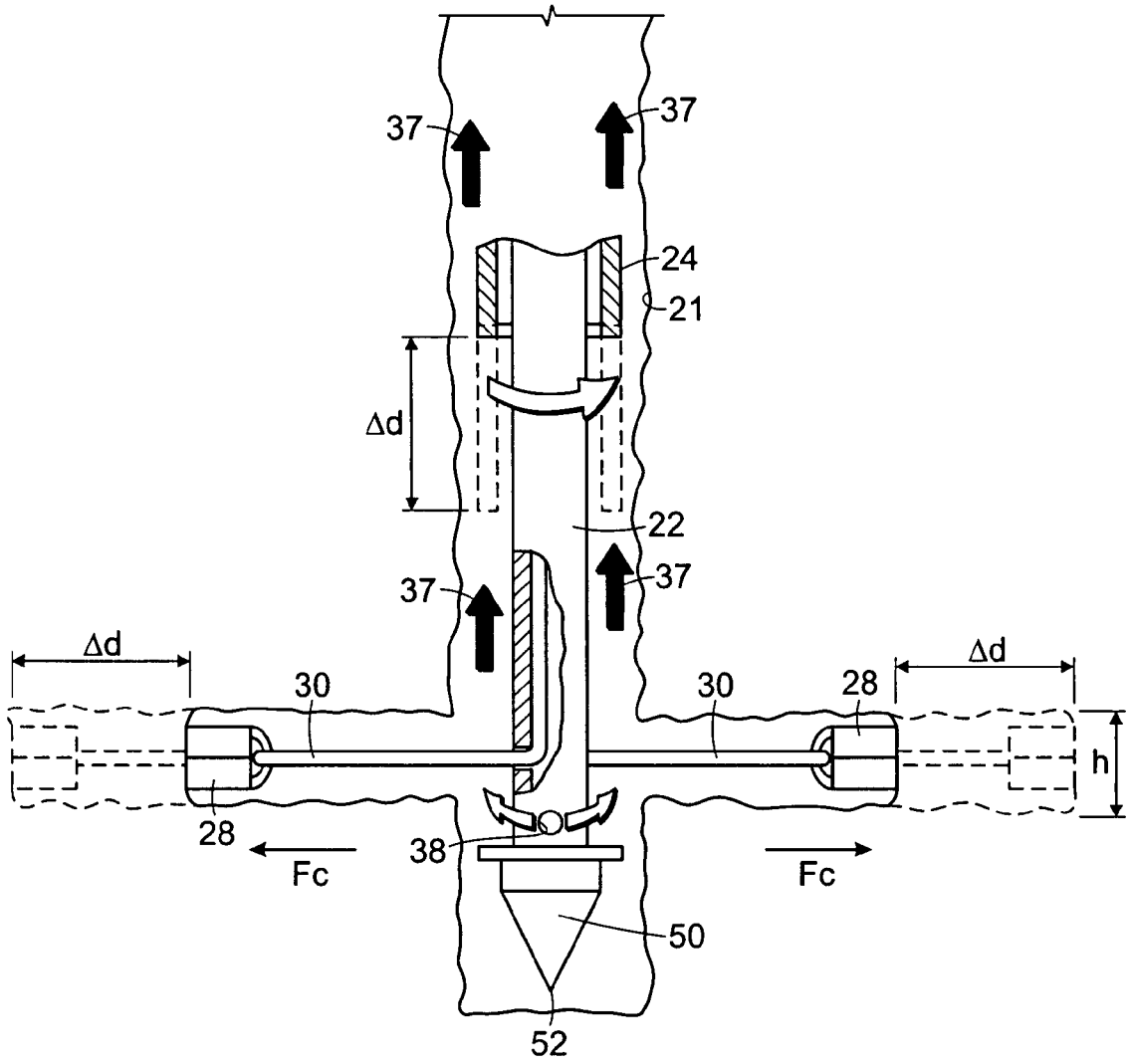
FIG. 2 is a partial cross-sectional view of the mining device of FIG. 1 being used to mine a coal seam.

In various embodiments, referring to FIG. 2, the distance in which cutting members 28 are moved relative to axis 26 can be directly proportional to the distance in which second housing portion 24 is moved relative to first housing portion 22. More particularly, in these embodiments, if second housing portion 24 is moved a distance $\Delta d$ relative to first housing portion 22 by applying a force to proximal end 25, cutting members 28 can move a corresponding distance $\Delta d$ relative to axis 26. In effect, these distances are directly related in a 1:1 relationship; however, the invention is not so limited. In various alternative embodiments, these distances can be directly related in a relationship other than 1:1, including 2:1, for example. In such embodiments, although not illustrated, the mining device can include a pulley system which can convert the change in distance $\Delta d$ between first housing portion 22 and second housing portion 24 to a corresponding change in distance $\Delta d/2$ between cutting members 28 and axis 26. In these embodiments, although the distance that cutting members 28 are moved relative to axis 26 is halved with respect to the change in distance between housing portions 22 and 24, the mechanical advantage to retract cutting members 28, for example, is doubled. In some circumstances, as a result, these mining devices can apply a greater force through cables 30 in order to retract cutting members 28 if they become stuck in the ground, for example, than mining devices having a 1:1 relationship as described above.

In various embodiments, the material removed or loosened from the sidewalls of hole 21 can be evacuated from hole 21 during the operation of mining device 20. More particularly, in at least one embodiment, the rotation of cutting members 28 and cables 30 within hole 21 can blow the material upwardly as represented by dark arrows 37 in FIG. 2. In effect, cutting members 28 and cables 30 can facilitate the movement of the material upwardly through hole 21. In various embodiments, mining device 20 can utilize pressurized air, for example, supplied thereto to push the material upwardly through hole 21. In at least one embodiment, referring to FIG. 2, a conduit, although not illustrated, can be engaged with mining device 20 such that the pressurized air exits mining device 20 through aperture 38 and pushes the material upwardly through hole 21. Mining device 20 can include any suitable number of apertures 38 which can be located in any suitable location in mining device 20 to achieve the above-described result. In various embodiments, although not illustrated, cables 30 can include an elongate aperture extending therethrough which can be configured to communicate the pressurized air to various locations along cables 30 including locations in, or at least adjacent to, cutting members 28. In such embodiments, the flow of air and loosened material within hole 21 can be streamlined such that the air can flow from the outermost perimeter of hole 21 to its innermost portion. In other various embodiments, mining device 20 can be removed from hole 21 and the material can then be removed from hole 21 via a vacuum draw, for example.

As described above, cutting members 28 can be rotated about axis 26 by cables 30. Cutting members 28 can be tethered to cables 30 in any suitable manner. Referring to FIG. 1, each cutting member 28 can include a connector 29 which defines a cavity 31 between the body of the cutting member and connector 29. In at least one embodiment, an end of cable 30 can be passed through cavity 31 and then fastened, or otherwise fixed, to an adjacent portion of cable 30 to tether cutting member 28 thereto. Cutting member 28, in the illustrated embodiment, can be comprised of a body having a substantially square cross-section and edges 33 which can extend along the length thereof and can be configured to cut material from the sidewalls of hole 21.

Figure 3:
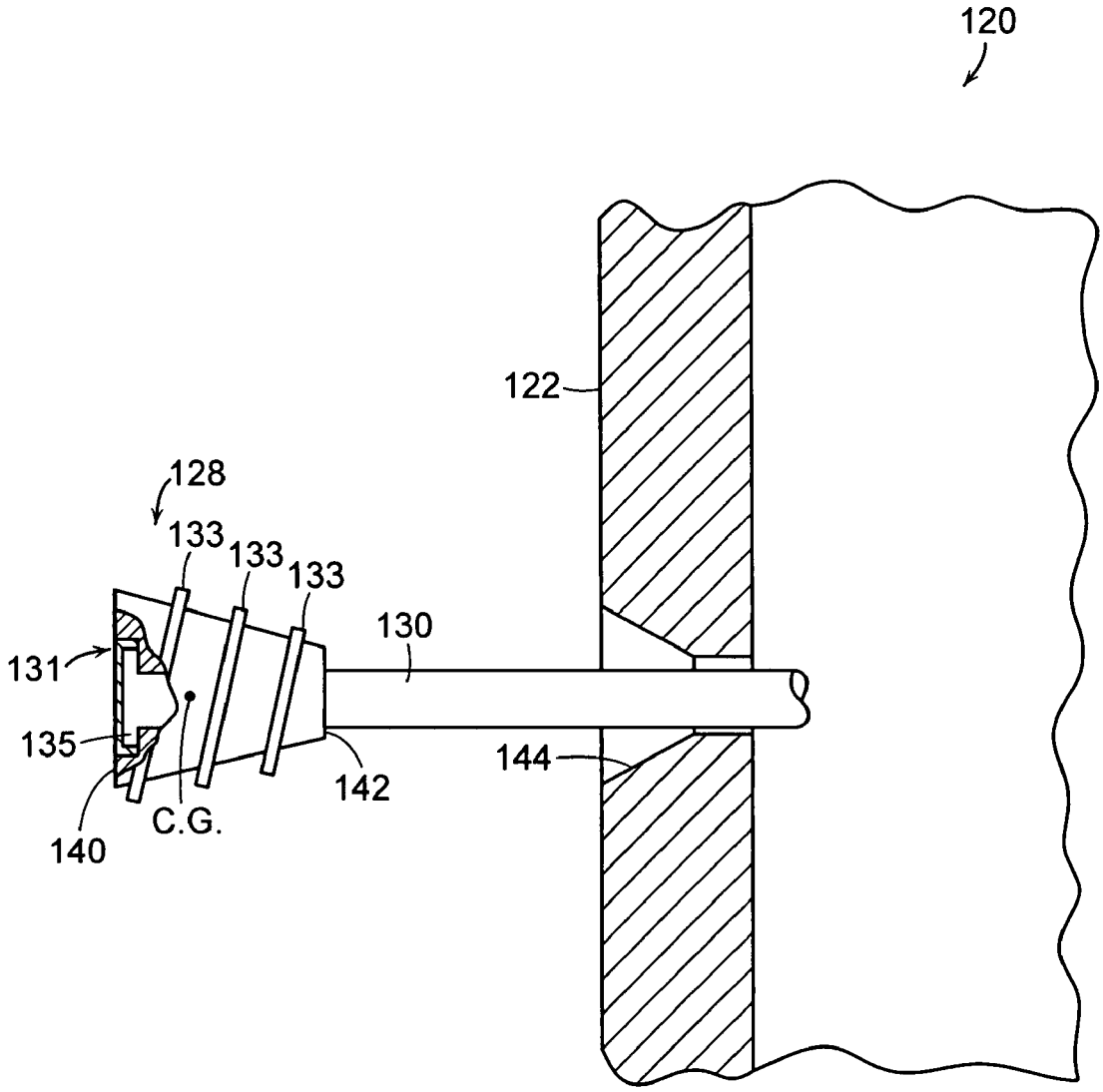
FIG. 3 is an elevational view of a cutting member of a mining device in accordance with an alternative embodiment of the present invention with portions of the mining device illustrated in cross-section.

In other various embodiments, referring to FIG. 3, cutting members 128 can include a frustoconical body having a major diameter 140, a minor diameter 142, and a tapered surface therebetween. Each cutting member 128 can further include cutting surfaces 133 extending from the frustoconical body which are configured, similar to the above, to remove material from the sidewalls of hole 21. In at least one embodiment, each cutting member 128 can include a cavity 131 which is configured to receive an end of a cable 130. In these embodiments, referring to FIG. 3, each cable 130 can include an enlarged end 135 which can be configured to retain cutting members 128 on cables 130. In at least one such embodiment, enlarged end 135 can be press-fit within cavity 131. In various embodiments, the mining device can include a drive system configured to rotate cables 130 and/or cutting members 128 about axes defined by cables 130. In such embodiments, the cutting members 128 can impart additional energy to the surrounding material and can be especially useful when removing hard materials. In other various embodiments, enlarged end 135 and cavity 131 can be configured to allow cutting member 128 to rotate about cable 130. In these embodiments, cutting members 128, when they collide with the sidewalls of hole, can spin about cables 130 to reduce the amount of torque that is transferred into cables 130. These features can be particularly advantageous in embodiments where cables 130, when exposed to sufficient quantities of torque, could be become twisted or kinked, for example, in a manner which reduces their ability to contact the sidewalls of hole 21 as intended.

In various embodiments, the mining device can include recesses configured to receive at least a portion of the cutting members when the cutting members are positioned against or adjacent to the housing of the mining device. In at least one such embodiment, referring to FIG. 3, first housing portion 122 can include recess 144 which can be configured to receive a portion of a cutting member 128 such that the cutting member can be at least partially recessed within first housing portion 122. As a result of recess 144, mining device 120 can be more compact when it is inserted into hole 21 and the possibility of mining device 120 becoming stuck within hole 21 can be reduced. In various embodiments, the recesses can be contoured to substantially match the outer profile of the cutting members which can provide a snug fit therebetween. In at least one such embodiment, referring to FIG. 3, recess 144 can be configured to receive minor diameter 142 of cutting member 128. In these embodiments, although the center of gravity, i.e., C.G., of the frustoconical body can be positioned outside of first housing portion 122, this orientation of the frustoconical body can provide enhanced cutting capability. More particularly, it can be advantageous, in various embodiments, for the distance between the center of gravity of the cutting members and the axis of rotation of the mining device to be larger in order to have a greater inertial momentum, and energy, that can be delivered by the cutting members to the sidewalls of hole 21.

Figure 4:
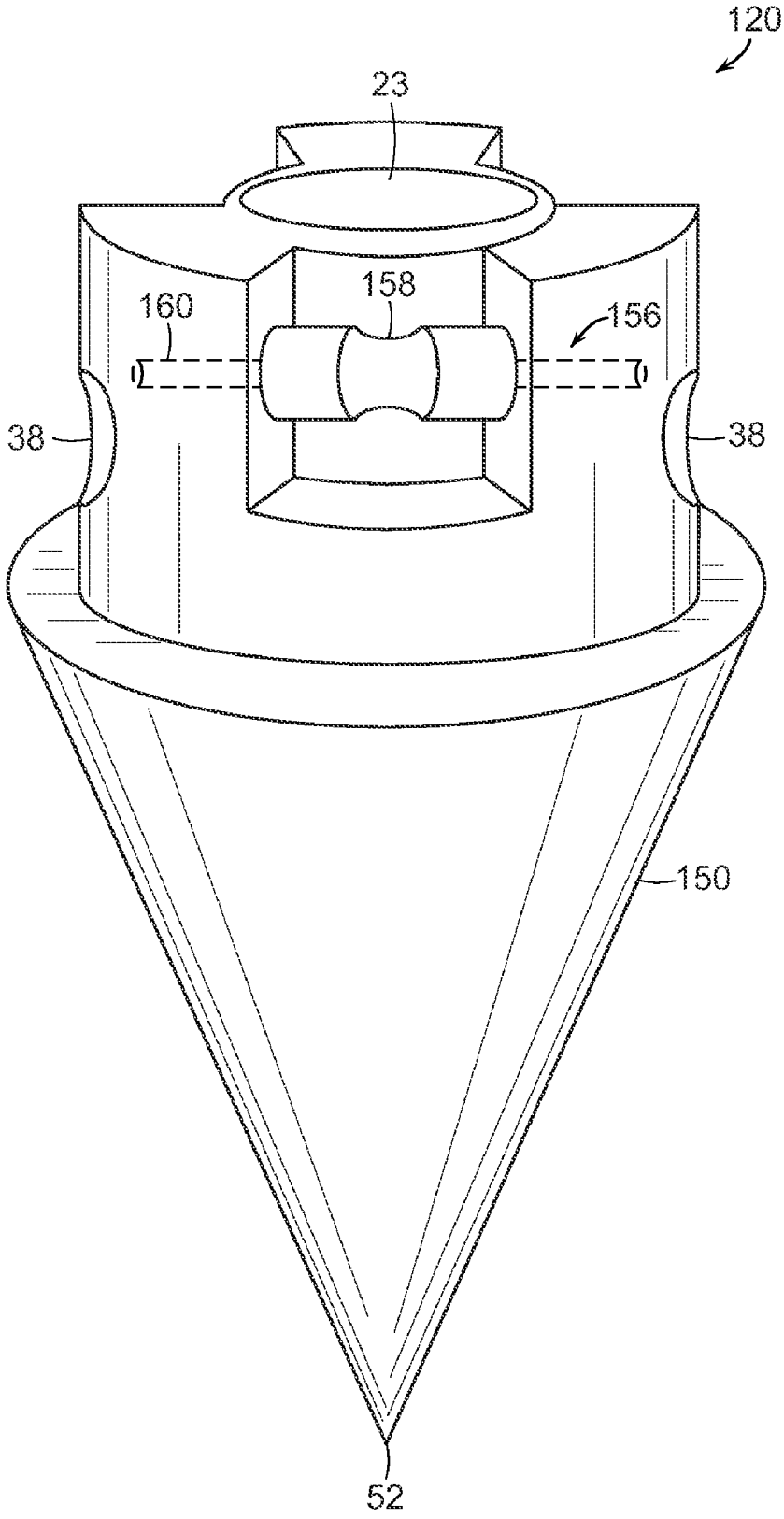
FIG. 4 is a perspective view of a tip of a mining device in accordance with an embodiment of the present invention.

Referring to FIG. 2, a mining device in accordance with an embodiment of the present invention can be positioned within hole 21 such that the distal tip of the mining device contacts the bottom of hole 21. In one such embodiment, mining device 20 can include spin tip 50 which can include point 52 about which mining device 20 can be rotated. In the present embodiment, point 52 is positioned along axis 26; however, in other various embodiments, point 52 can be positioned off-center with respect to axis 26 to provide an eccentric motion to mining device 20 when it is rotated, as described above. In various embodiments, referring to FIG. 4, the spin tip can include casters 156 about which cables 130 can be positioned. In such embodiments, casters 156 can facilitate the extension and/or retraction of cutting members 128 such that cables 130 do not snag or become stuck on various edges or other features of mining device 120. In the illustrated embodiment, each caster 156 can include a groove 158 which can be configured to receive and guide a cable 130 as it is moved thereover and a pin 160 which can allow each caster 156 to rotate and thereby reduce friction between the caster and the cable. Although casters 156 have been described herein as being mounted to spin tip 150, the invention is not so limited. On the contrary, although not illustrated, casters 156 can be mounted to first housing portions 22 and/or 122, or any other suitable portion of the mining device, to achieve the above-described results.

In various alternative embodiments, mining device 20 can include a substantially flat base, for example, which can be configured to support mining device 20 on a bottom surface of a bore hole. In such embodiments, the flat base can distribute a downward force applied to first housing portion 22 across a large area and at least minimize the distance in which the base may sink into soft material underlying the flat base, including soft clay, for example. In embodiments where the flat base is rotated on the bottom surface of the bore hole, the base can substantially heat the surrounding material. In at least one alternative embodiment, the flat base can include a ground-contacting portion, a bearing, and a connector portion. The connector portion can be mounted to, or integrally formed with, first housing portion 22 where the bearing can permit relative rotation between the ground-contacting portion and first housing portion 22. In such embodiments, the ground-contacting portion can remain substantially stationary when first housing portion 22 is rotated such that the surrounding material is not heated by the ground-contacting portion. In at least one embodiment, the ground-contacting portion can include projections extending therefrom which can be configured to engage, or grip, the ground and assist in preventing the ground-contacting portion from rotating relative to the ground.

In various embodiments, as described above, the cutting members can cut a cylinder of material, for example, surrounding the mining device where the diameter of this cylinder can be increased by moving the second housing portion relative to the first housing portion, for example, and extending the cutting members therefrom. In at least one embodiment, although not illustrated, the mining device can include a locking system configured to clamp, or otherwise limit, relative movement between the first and second housing portions. In these embodiments, after the first and second housing portions have been locked together, the mining device can be lifted and/or lowered to increase the height, h (FIG. 2), of the cylinder of removed material. Thereafter, the first and second housing portions can be unlocked and then repositioned to extend the cutting members therefrom. This process can be repeated to increase the diameter and height of the cylinder of removed material until the desired dimensions are achieved.

Figure 6:
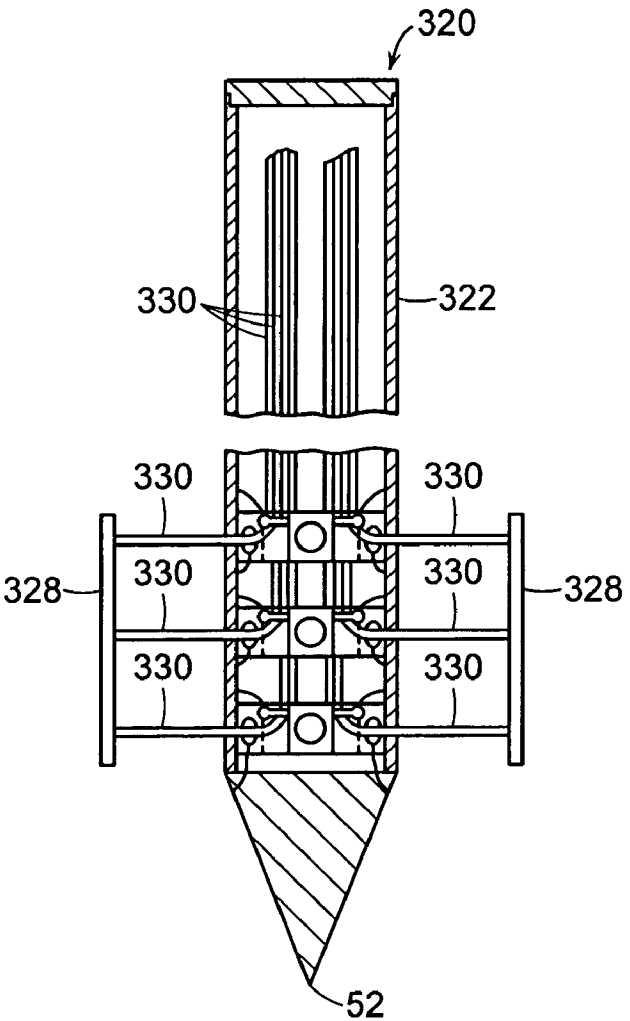
FIG. 6 is a partial elevational view of a mining device in accordance with an alternative embodiment of the present invention having multiple cables attached to each of the cutting members.
Figure 5:
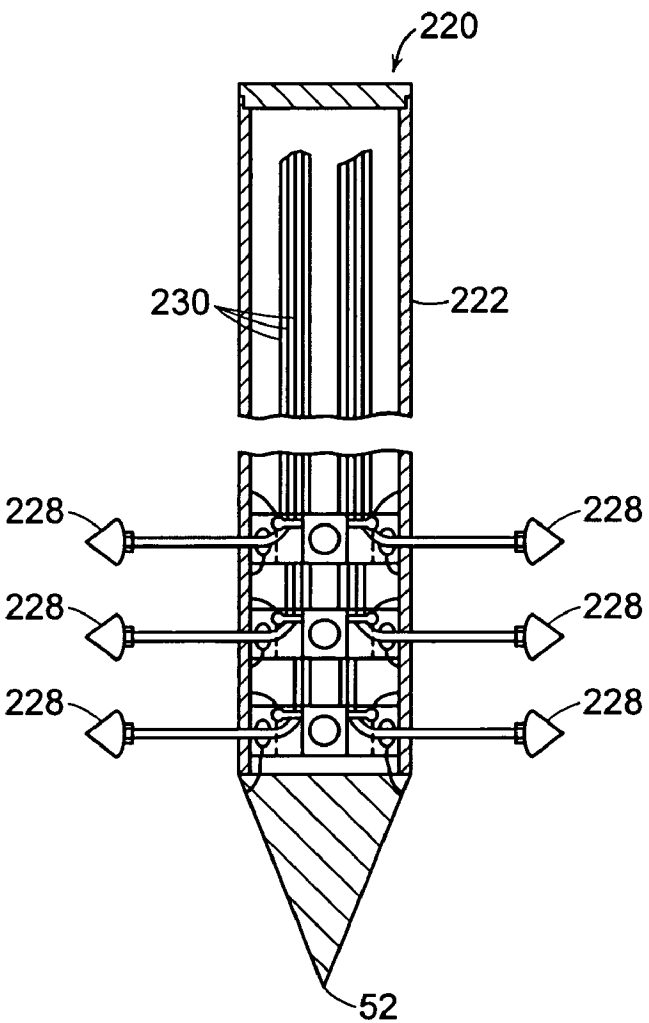
FIG. 5 is a partial elevational view of a mining device in accordance with an alternative embodiment of the present invention having multiple rows of cutting members.

In various embodiments, the mining device can include several rows of cutting members. More particularly, referring to FIG. 5, mining device 220 can include more than one row of cutting members 228 which are configured to be withdrawn and retracted with respect to first housing portion 222 by cables 230 in the manners described above. Such devices can remove a cylinder of material having a greater height, h, than devices having only one row of cutting members. In other various embodiments, the mining device can include cutting members which are withdrawn and retracted by several rows of cables. More particularly, referring to FIG. 6, mining device 320 can include more than row of cables 330 which are connected to the same cutting member 328. As a result of having several rows of cables 330, large cutting members 328 can be more readily controlled than with one row of cables. In these embodiments, the dimensions of cutting members 328 can be configured to provide the desired height, h, of material that is removed.

In various embodiments, as outlined above, the mining devices of the present invention can be utilized to extract valuable materials from the ground. In at least one embodiment, however, the holes, or cavities, created within the ground by these mining devices can be utilized to store various materials therein including water, fuels, and/or garbage, for example. Depending of the composition of the ground, in various embodiments, such holes, or cavities, can be useful for storing natural gas. In at least one such embodiment, previously extracted natural gas can be piped into these holes and the holes can be 'capped' to prevent the gas from escaping therefrom. In various other embodiments, the radially extending cutting members of these mining devices can be configured to create 'notches' in natural gas and/or oil wells to increase the output, or production, from the wells. More particularly, in at least one embodiment, the notches can increase the surface area of a well, especially in a 'pay zone', in order to increase the output from the well. Stated another way, the surface area of a well is typically directly proportional to the production of the well and the mining devices disclosed herein can be utilized to increase the surface area.

While this invention has been described as having exemplary designs, the present invention may be further modified within the spirit and scope of the disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A rotary mining apparatus, comprising:

a first housing portion, wherein said first housing portion includes a first aperture;

a second housing portion, wherein said second housing portion is movable relative to said first housing portion along an axis, wherein said second housing portion comprises a drive end adapted to receive a rotational drive force, and wherein said first housing portion and said second housing portion are configured to be rotated about said axis;

a flexible connecting member, wherein said connecting member is mounted to said second housing portion and extends through said first aperture in said first housing portion, and wherein said flexible connecting member comprises at least one of a solid-core cable and a twisted-strand cable; and a cutting member mounted to said connecting member, wherein said cutting member is configured to be rotated about said axis when said first housing portion and said second housing portion are rotated about said axis, and wherein said cutting member is configured to be radially extended with respect to said axis when said second housing portion is moved relative to said first housing portion along said axis.

2. A rotary mining apparatus, comprising:

a first housing portion, wherein said first housing portion includes a first aperture;

a second housing portion, wherein said second housing portion is movable relative to said first housing portion along an axis, wherein said second housing portion comprises a drive end adapted to receive a rotational drive force, and wherein said first housing portion and second housing portion are configured to be rotated about said axis;

a flexible connecting member, wherein said connecting member is mounted to said second housing portion and extends through said first aperture in said first housing portion;

a cutting member mounted to said connecting member, wherein said cutting member is configured to be rotated about said axis when said first housing portion and said second housing portion are rotated about said axis, and wherein said cutting member is configured to be radially extended with respect to said axis when said second housing portion is moved relative to said first housing portion along said axis; and a spring engaged with said first housing portion and said second housing portion, wherein said spring is configured to move said second housing portion relative to said first housing portion.

3. A rotary mining apparatus, comprising:

a first housing portion, wherein said first housing portion includes a first aperture;

a second housing portion, wherein said second housing portion is movable relative to said first housing portion along an axis, wherein said second housing portion comprises a drive end adapted to receive a rotational drive force, and wherein said first housing portion and second housing portion are configured to be rotated about said axis;

a flexible connecting member, wherein said connecting member is mounted to said second housing portion and extends through said first aperture in said first housing portion;

a cutting member mounted to said connecting member, wherein said cutting member is configured to be rotated about said axis when said first housing portion and said second housing portion are rotated about said axis, and wherein said cutting member is configured to be radially extended with respect to said axis when said second housing portion is moved relative to said first housing portion along said axis; and a second flexible connecting member and a second cutting member mounted to said second connecting member, wherein said first housing portion further includes a second aperture, wherein said second connecting member is mounted to said second housing portion and extends through said second aperture, wherein said second cutting member is configured to be rotated about said axis when said first housing portion and said second housing portion are rotated about said axis, and wherein said second cutting member is configured to be radially extended with respect to said axis when said second housing portion is moved relative to said first housing portion along said axis.

4. The rotary mining apparatus of claim 3, wherein said first housing portion includes a proximal end and a distal end, and wherein said second aperture is located closer to said proximal end of said first housing portion than said first aperture.

5. A rotary mining apparatus, comprising:

a first housing portion, wherein said first housing portion includes a first aperture;

a second housing portion, wherein said second housing portion is movable relative to said first housing portion along an axis, wherein said second housing portion comprises a drive end adapted to receive a rotational drive force, and wherein said first housing portion and second housing portion are configured to be rotated about said axis;

a flexible connecting member, wherein said connecting member is mounted to said second housing portion and extends through said first aperture in said first housing portion;

a cutting member mounted to said connecting member, wherein said cutting member is configured to be rotated about said axis when said first housing portion and said second housing portion are rotated about said axis, and wherein said cutting member is configured to be radially extended with respect to said axis when said second housing portion is moved relative to said first housing portion along said axis; and a caster, wherein said connecting member includes a cable, and wherein said caster includes a groove configured to at least partially receive said cable and guide said cable as said cutting member is extended with respect to said axis.

6. A rotary mining apparatus, comprising:

a first housing portion, wherein said first housing portion includes a first aperture;

a second housing portion, wherein said second housing portion is movable relative to said first housing portion along an axis, wherein said second housing portion comprises a drive end adapted to receive a rotational drive force, and wherein said first housing portion and second housing portion are configured to be rotated about said axis;

a flexible connecting member, wherein said connecting member is mounted to said second housing portion and extends through said first aperture in said first housing portion; and a cutting member mounted to said connecting member, wherein said cutting member is configured to be rotated about said axis when said first housing portion and said second housing portion are rotated about said axis, and wherein said cutting member is configured to be radially extended with respect to said axis when said second housing portion is moved relative to said first housing portion along said axis, wherein said flexible connecting member includes a cable.

7. The rotary mining apparatus of claim 6, wherein said first housing portion includes a distal end, wherein said second housing portion includes a distal end, and wherein, when said distal end of said second housing portion is moved toward said distal end of said first housing portion, said cutting member is extended radially away from said axis.

8. The rotary mining apparatus of claim 7, wherein, when said distal end of said second housing portion is moved away from said distal end of said first housing portion, said cutting member is retracted radially toward said axis.

9. The rotary mining apparatus of claim 6, wherein said cutting member is radially extendable between a first position and a second position with respect to said axis.

10. The rotary mining apparatus of claim 9, wherein said cutting member is positioned adjacent said first housing when said cutting member is in said first position.

11. The rotary mining apparatus of claim 9, wherein said first housing portion includes a recess at least partially surrounding said aperture, and wherein said recess is configured to receive at least a portion of said cutting member therein when said cutting member is in said first position.

12. The rotary mining apparatus of claim 6, wherein at least a portion of said cutting member is frustoconical and includes a major diameter and a minor diameter, and wherein said major diameter is larger than said minor diameter.

13. The rotary mining apparatus of claim 12, wherein said connecting member is engaged with said cutting member adjacent to said major diameter, and wherein, when said cutting member is rotated about said axis, said major diameter is positioned further away from said axis than said minor diameter.

14. A rotary mining apparatus, comprising:

a first housing portion, a second housing portion, wherein said second housing portion is movable relative to said first housing portion with respect to an axis, wherein said second housing portion comprises a drive end adapted to receive a rotational drive force, a flexible connecting member, wherein said connecting member is mounted to said second housing portion, and wherein said flexible connecting member comprises a cable; and a cutting member mounted to said connecting member, wherein said cutting member is configured to be rotated about said axis when said first housing portion is rotated about said axis, and wherein said cutting member is movable between a first radial position and a second radial position with respect to said axis when said second housing portion is moved relative to said first housing portion with respect to said axis, wherein said first housing portion includes a first aperture, wherein said connecting member extends through said first aperture, wherein said first housing portion further includes a recess at least partially surrounding said first aperture, and wherein said recess is configured to receive at least a portion of said cutting member therein when said cutting member is in said first position.

15. A rotary mining apparatus, comprising:

a first housing portion, a second housing portion, wherein said second housing portion is movable relative to said first housing portion with respect to an axis, wherein said second housing portion comprises a drive end adapted to receive a rotational drive force, a flexible connecting member, wherein said connecting member is mounted to said second housing portion; and a cutting member mounted to said connecting member, wherein said cutting member is configured to be rotated about said axis when said first housing portion is rotated about said axis, and wherein said cutting member is movable between a first radial position and a second radial position with respect to said axis when said second housing portion is moved relative to said first housing portion with respect to said axis, wherein said first housing portion includes a first aperture, wherein said connecting member extends through said first aperture, wherein said first housing portion further includes a recess at least partially surrounding said first aperture, and wherein said recess is configured to receive at least a portion of said cutting member therein when said cutting member is in said first position; and a second connecting member and a second cutting member mounted to said second connecting member, wherein said first housing portion further includes a second aperture, wherein said second connecting member is mounted to said second housing portion and extends through said second aperture, wherein said second cutting member is configured to be rotated about said axis when said first housing portion is rotated about said axis, wherein said cutting member is movable between a first radial position and a second radial position with respect to said axis when said second housing portion is moved relative to said first housing portion with respect to said axis, wherein said first housing portion includes a proximal end and a distal end, and wherein said second aperture is located closer to said proximal end of said first housing portion than said first aperture.

* * * * *